US006057253A

United States Patent [19]

Groshens

[11] Patent Number: 6,057,253

[45] Date of Patent: May 2, 2000

[54] REINFORCING BASE FABRIC FOR A SHIRT COLLAR OR AN ANALOGOUS PIECE

[75] Inventor: Pierre Groshens, Flamicourt, France

[73] Assignee: Lainiere de Picardie, France

[21] Appl. No.: 08/970,418

[22] Filed: Nov. 14, 1997

[30] Foreign Application Priority Data

Nov. 18, 1996 [FR] France ..... 96 14014

[51] Int. Cl.[7] ..... D04B 1/00

[52] U.S. Cl. ..... 442/313; 442/314; 2/98; 223/2

[58] Field of Search ..... 442/313, 314, 442/308, 305; 2/98, 116, 129; 223/2, 4

[56] References Cited

U.S. PATENT DOCUMENTS

| | | | |
|---|---|---|---|
| 4,333,982 | 6/1982 | Rand | 428/245 |
| 4,518,640 | 5/1985 | Wilkens | 442/314 X |
| 4,608,290 | 8/1986 | Schnegg | 442/313 X |
| 4,615,934 | 10/1986 | Ellison | 442/313 |
| 5,292,576 | 3/1994 | Sanders | 442/313 |
| 5,688,558 | 11/1997 | Groshens | 427/288 |

FOREIGN PATENT DOCUMENTS

| | | |
|---|---|---|
| 2462456 | 3/1981 | France . |
| 2531616 | 2/1984 | France . |
| 2570577 | 3/1986 | France . |
| 2609873 | 7/1988 | France . |
| 2710078 A1 | 3/1995 | France . |

*Primary Examiner*—Daniel Zirker
*Attorney, Agent, or Firm*—Kilpatrick Stockton LLP

[57] ABSTRACT

The invention concerns a reinforcing base fabric (1) for a shirt collar or an analogous piece, in the form of a weft knit fabric (2) and comprising an insertion of reinforcing and stabilizing yarns (5) extending in the direction of the warp between the wales.

18 Claims, 3 Drawing Sheets

1
6
10
D
9

11
1
11

5
6
7
8
1

REINFORCING BASE FABRIC FOR A SHIRT COLLAR OR AN ANALOGOUS PIECE

The invention concerns a reinforcing base fabric for a shirt collar or a similar piece; the application of such a reinforcing base fabric to a shirt collar or a similar piece and, finally, a method for achieving such a collar.

Clothing collars such as shirt collars, blouse collars or equivalent pieces including a canvas are already known.

Documents FR-A-2 570 577 and FR-A-2 609 873 can be referred to, for example.

Conventionally, canvases or reinforcing pieces for shirt collars are made either woven, of polyester for example, or nonwoven.

However, existing shirt collars have a disadvantage in that the dimensional stability of the collar cannot be perfectly ensured with time. Indeed, upon repeated washing of the shirt, and therefore of the collar, the stabilization provided by the reinforcing canvas of the collar deteriorates, leading to a modification of the neck measurement, which is particularly inconvenient. This loss of neck measurement can attain 1.5 or even 2.5 cm, if not more.

Reinforcing pieces for the localized stiffening of textiles (see FR-A-2 531 616), fusible canvases (see FRA-2 462 456) and, finally, fusible interlinings in the form of weft knit fabrics (see FR-A-2 710 078) are also known in the art.

Chemical treatments of base fabrics, intended to confer or to improve their crease resistance properties are also known (see FR-A-2 727 136).

The problem at the root of the invention is to ensure the dimensional stability of a shirt collar or an equivalent piece considering the regular upkeep of this article of clothing, including repeated washing and ironing.

For this purpose, the invention implements a reinforcing base fabric for a shirt collar or an analogous piece, in the form of a weft knit fabric comprising an insertion of reinforcing and stabilizing yarns extending in the direction of the warp between the wales.

According to the invention, the reinforcing and stabilizing yarns are rectilinear or substantially rectilinear, and free or substantially free from crimp stress. These reinforcing and stabilizing yarns are heat stabilized.

Such a reinforcing base fabric may also include an inserted nonwoven lap.

The reinforcing base fabric may also comprise an adhesive or fusible material intended to ensure its subsequent association with the collar.

The reinforcing and stabilizing yarns consist of synthetic fibers or filaments.

According to another aspect, the invention relates to the application of such a reinforcing base fabric to a shirt collar or an analogous piece, so as to improve its dimensional stability with time, particularly following repeated washing and ironing.

The dimensional stability of the collar may be improved in the large direction, i.e. the neck measurement or, alternately, in the direction perpendicular to the large direction of the collar.

According to a third aspect, the invention concerns a shirt collar or an equivalent piece including one or more pieces of fabric and a reinforcing base fabric such as described above associated with it.

The reinforcing base fabric may act as a canvas per se, or it may reinforce a canvas itself associated with the collar piece(s).

The reinforcing base fabric acting as a canvas per se includes a coat of adhesive or fusible material to ensure its association with the collar piece(s).

In the case where the reinforcing base fabric acts as a canvas reinforcement, the reinforcing base fabric is associated with the canvas through heat welding, simultaneously with the thermofusing of the canvas.

Such a canvas is made of cotton or equivalent.

According to a first embodiment, the reinforcing and stabilizing yarns of the reinforcing base fabric are arranged in the large direction of the collar, i.e. the neck measurement. In this case, the warp of the reinforcing base fabric extends in the direction of the neck measurement.

According to a second embodiment, the reinforcing and stabilizing yarns are arranged in the direction perpendicular to the large direction of the collar.

In this case, the warp of the reinforcing base fabric extends in the direction perpendicular to the neck measurement.

A collar such as described above may include two pieces of fabric, top and bottom, respectively, assembled together and between which the reinforcing base fabric is inserted.

According to a fourth and last aspect of the invention, a method for achieving a collar such as described above is provided which includes a step consisting in associating a reinforcing base fabric such as described above with the piece(s) of fabric of the collar.

According to a first alternate embodiment, the reinforcing base fabric is directly associated with the piece(s) of fabric of the collar.

According to a second possible alternate embodiment, the reinforcing base fabric is first associated with a canvas and the canvas thus reinforced is then associated with the piece(s) of fabric forming the collar.

Further characteristics and advantages of the invention will be better understood upon reading the description which follows, provided on an illustrative basis and made with reference to the attached drawings, in which.

Figure 1:
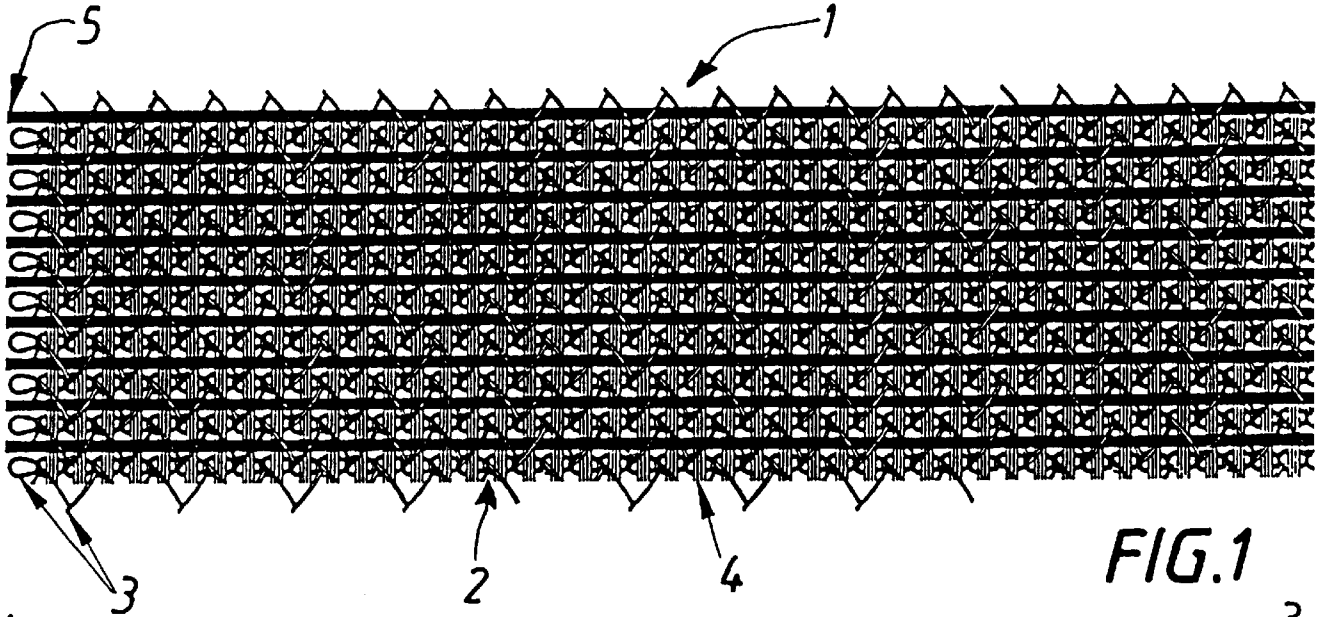
FIGS. 1 and 2 are schematic front views of two embodiments of the reinforcing base fabric according to the invention.
Figure 2:
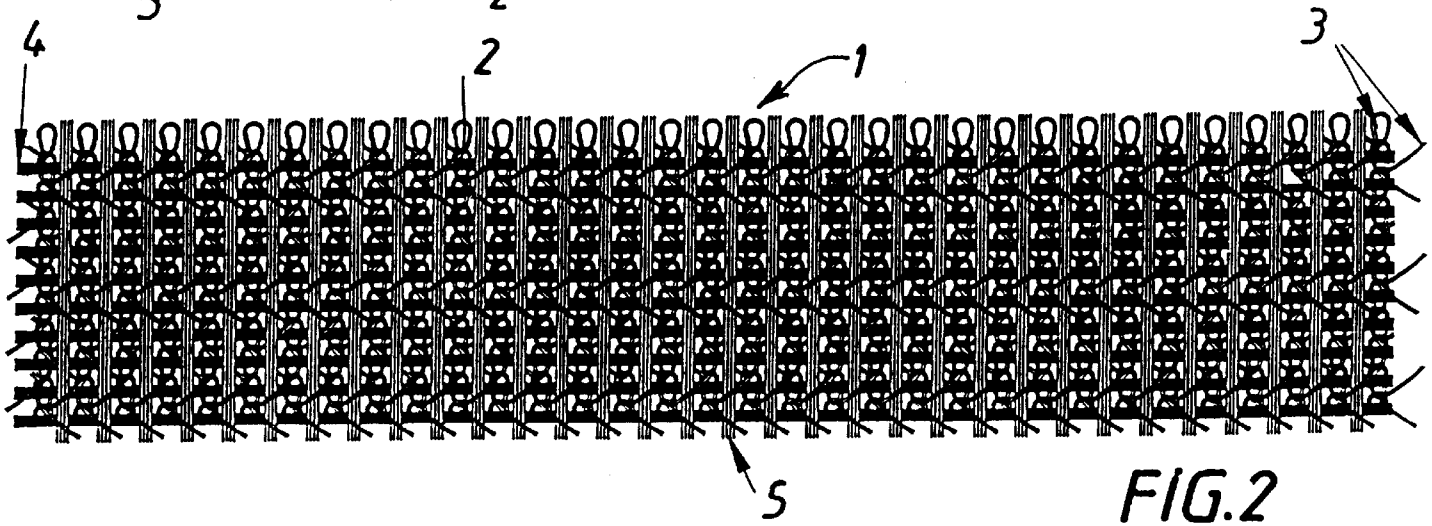

The reinforcing base fabric 1 according to the invention consists of a weft knit fabric 2 comprising warp yarns 3 and weft yarns 4. The weft knit fabric 2 further comprises reinforcing and stabilizing yarns 5 extending in the direction of the warp between the wales of the knitted fabric 2 (FIGS. 1 and 2).

Weft knit fabrics are known in themselves and will therefore not be described in greater detail herein.

The reinforcing and stabilizing yarns 5 are arranged in each space between two adjacent wales or only in certain spaces, the other intermediary spaces being free from yarns 5.

This arrangement is determined according to the reinforcing and stabilizing qualities pursued for the base fabric 1 and the objectives of the specific application which it is intended for.

Likewise, the reinforcing and stabilizing yarns 5 may be arranged in a regular or irregular manner depending on the regions considered, the reinforcement and stabilization themselves being homogeneous or non-homogeneous in the various regions of the base fabric.

For example, it is possible for the knitted fabric to include yarns 5 in each space between two adjacent wales in certain regions and for the yarns 5 to only concern certain spaces in other regions.

In order to completely fulfil their reinforcing function and, most importantly, their stabilizing function, the yarns 5 are arranged in a rectilinear manner, preferably in a perfectly rectilinear manner, and they are free or substantially free from crimp stress.

This characteristic is obtained due to the fact that the yarns 5 do not participate in the actual stitches and are not conformed by the crossing of the warp yarns 3 and weft yarns 4 of the knitted fabric 2.

In order to enhance the stabilizing qualities, the yarns 5 themselves are heat stabilized. This quality is preferably obtained without adding a synthetic or chemical stabilizing resin.

The yarns 5 which may be used consist of synthetic fibers or filaments, for example.

The dimensional stability of the yarns 5 lengthwise results in the stability of the base fabric 1 in the direction of the warp. This dimensional stability makes it possible to enhance the dimensional stability of a shirt collar or an analogous piece 6.

According to a possible embodiment, the base fabric 1 includes an adhesive or fusible material intended to ensure the subsequent association of the base fabric 1 with the collar 6, or possibly with an additional base fabric such as a canvas.

Depending on the implementation considered, the adhesive or fusible material may be arranged on only one face of the base fabric 1 or on both of its faces. The adhesive or fusible material may be arranged in a continuous layer or in points.

Methods making it possible to arrange an adhesive or fusible material on a textile substrate are known in themselves and will therefore not be described hereinafter.

According to another possible embodiment, the base fabric 1 also includes an inserted nonwoven lap. Such a nonwoven lap makes it possible to give the collar or the analogous piece 6 a certain volume.

A base fabric 1 such as described above is particularly intended for a shirt collar or any other equivalent piece 6 so as to improve its dimensional stability with time following repeated washing or ironing.

Figure 7:
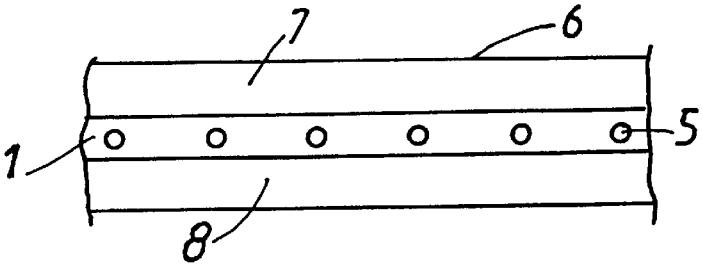
FIG. 7 is a partial sectional view along line IV—IV of FIG. 3.

In the embodiment shown, the collar 6 includes two pieces, top 7 and bottom 8, respectively, associated with one another and between which at least one base fabric 1 is inserted (FIG. 7).

The pieces 7, 8 are cut so as to comprise a part 9 referred to as the collar band, intended to be associated adjacent to the main part of the clothing, and a flap 10.

The two pieces 7, 8 are associated with one another either sewn to the periphery or thermofused.

Figure 3:
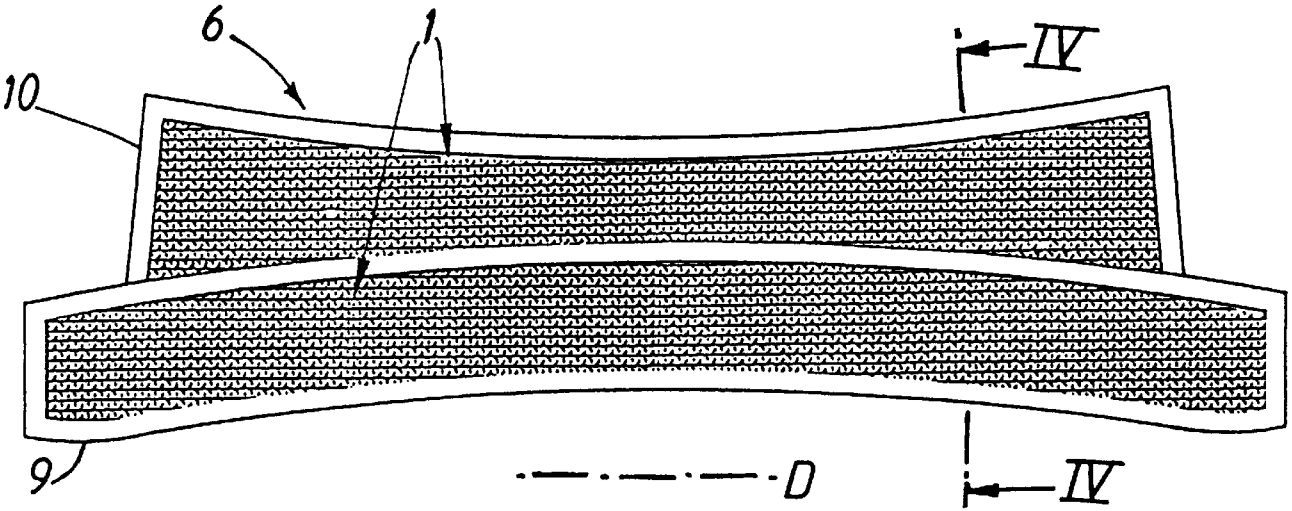
FIGS. 3 and 4 are two schematic front views, in horizontal position, of a shirt collar or an equivalent piece including a reinforcing base fabric as shown in FIG. 1.

According to a first alternate embodiment, the dimensional stability pursued corresponds to that of the large direction of this piece, indicated by reference D in FIG. 3, i.e., in this case the neck measurement.

To ensure this stabilizing function, the base fabric 1 is arranged on the piece 6 with the yarns 5 arranged in the direction to be stabilized, i.e. direction D. To allow for a better understanding of the invention, in FIG. 1 the base fabric 1 is shown in the position in which it is associated with the shirt collar in FIG. 3.

In the case of the application considered—shirt collar or equivalent—the yarns 5 are arranged in the direction of the collar corresponding to the neck measurement.

Figure 5:
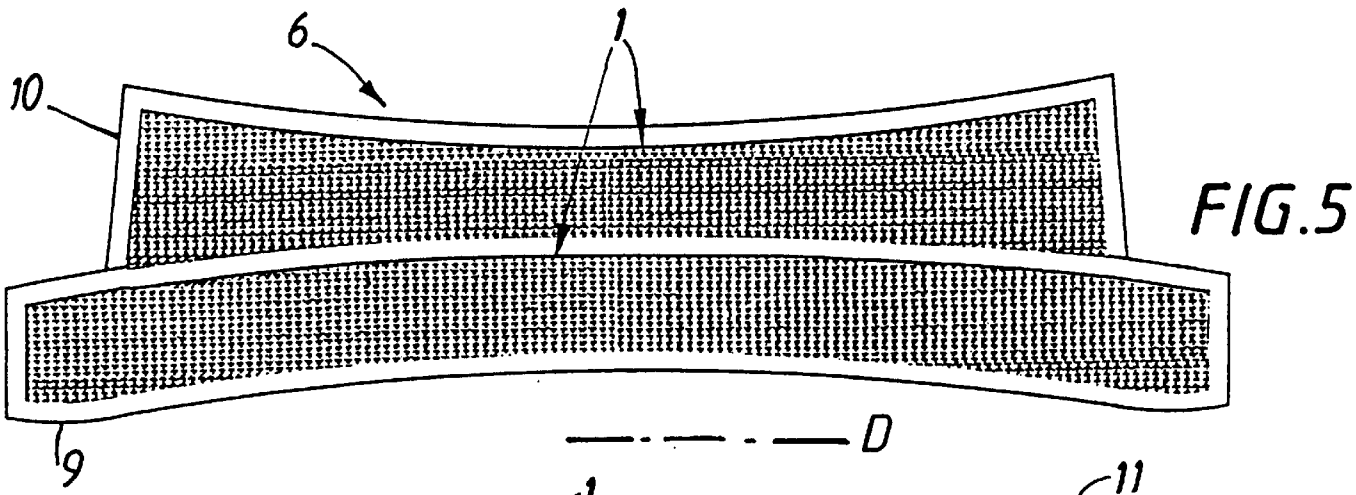
FIGS. 5 and 6 are two schematic front views, in horizontal position, of a shirt collar or an equivalent piece including a reinforcing base fabric as shown in FIG. 2.

According to a second embodiment, the dimensional stability pursued corresponds to the direction perpendicular to the large direction of the collar (FIG. 5).

In this case, to ensure its stabilizing function the base fabric 1 is associated with the collar 6 in the position in which it is shown in FIG. 2: the base fabric 1 is arranged on the piece 6 with the yarns 5 arranged in the direction to be stabilized, in this case the direction perpendicular to direction D.

According to first possible embodiment, the base fabric 1 acts as a canvas (FIGS. 3 and 5). In this case, the base fabric 1 includes the coat of adhesive or fusible material.

Figure 4:
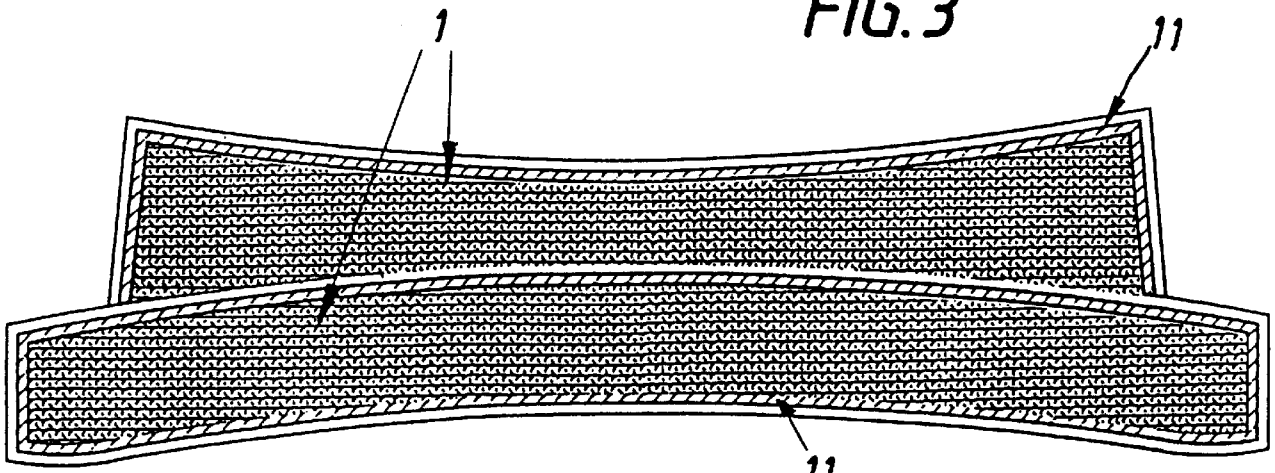
Figure 6:
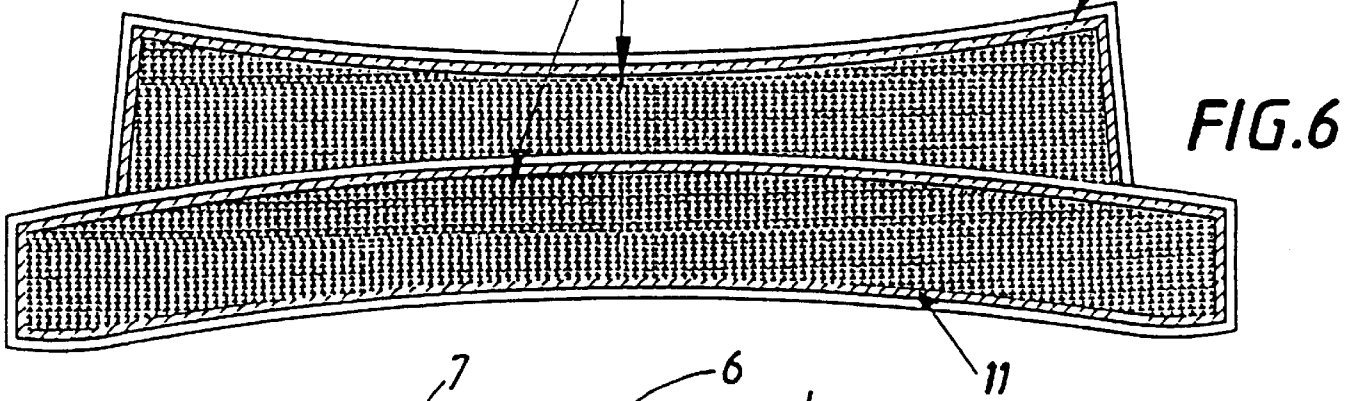

According to another possible embodiment (FIGS. 4 and 6), the base fabric 1 is associated with a canvas 11, which is itself associated with the pieces 7, 8.

In this last case, the base fabric 1 is associated with the canvas 11 through heat welding. Such a canvas 11 may be conventionally made of cotton or equivalent.

Alternately, the base fabric 1 may be applied as a reinforcement on a first layer of the same base fabric 1 bonded to the fabric of the collar.

The method for achieving a collar such as described above includes a step consisting of associating a base fabric 1 with the pieces 7, 8.

Depending on the embodiment considered, the base fabric 1 is either directly associated with the pieces 7, 8, or it is first associated with a canvas 11 which, thus reinforced, is then itself associated with the pieces 7, 8.

I claim:

1. A reinforcing base fabric for a shirt collar or an analogous piece, in the form of a weft knit fabric (2) comprising an insertion of reinforcing and stabilizing yarns (5) extending in the direction of the warp between the wales, the reinforcing and stabilizing yarns (5) being rectilinear or substantially rectilinear, and free or substantially free from crimp stress.

2. A reinforcing base fabric according to claim 1, characterised by the fact that the reinforcing and stabilizing yarns (5) are heat stabilized.

3. A reinforcing base fabric according to claim 1, characterised by the fact that it also includes an inserted nonwoven lap.

4. A reinforcing base fabric according to claim 1, characterised by the fact that it includes an adhesive or fusible material intended to ensure its subsequent association with a fabric or a canvas.

5. A reinforcing base fabric according to claim 1, characterised by the fact that the reinforcing and stabilizing yarns (5) consist of synthetic fibers or filaments.

6. Application of a reinforcing base fabric according to claim 1, to a shirt collar (6) or an analogous piece, so as to improve its dimensional stability with time, in the large direction.

7. Application of a reinforcing base fabric according to claim 1, to a shirt collar (6) or an analogous piece, so as to improve its dimensional stability with time, in the direction perpendicular to the large direction.

8. A shirt collar or an equivalent piece, including one or more pieces of fabric and at least one reinforcing base fabric according to claim 1 associated with it.

9. A collar according to claim 8, characterised by the fact that the reinforcing base fabric either acts as a canvas per se, or reinforces a canvas (11) itself associated with the collar piece(s).

10. A collar according to claim 9, characterised by the fact that the reinforcing base fabric acting as a canvas per se includes a coat of adhesive or fusible material to ensure its association with the collar piece(s).

11. A collar according to claim 9, characterised by the fact that the reinforcing base fabric acting as a reinforcement for the canvas (11) is associated with the latter through heat welding.

12. A collar according to claim 11, characterised by the fact that the canvas (11) is made of cotton or equivalent.

13. A collar according to claim 8, characterised by the fact that the reinforcing and stabilizing yarns (5) of the reinforcing base fabric are arranged in the large direction of the collar (6).

14. A collar according to claim 8, characterised by the fact that the reinforcing and stabilizing yarns (5) of the reinforcing base fabric are arranged in the direction perpendicular to the large direction of the collar.

15. A collar according to claim 8, characterised by the fact that it includes two pieces of fabric (7, 8), top and bottom, respectively, assembled together and between which the reinforcing base fabric is inserted and assembled.

16. A method for achieving a shirt collar or an equivalent piece, characterised by the fact that it includes a step consisting of associating a reinforcing base fabric according to claim 1 with the piece(s) of fabric of the collar.

17. A method according to claim 16, characterised by the fact that the reinforcing base fabric is directly associated with the piece(s) of the collar (6), the reinforcing base fabric acting as a canvas per se.

18. A method according to claim 16, characterised by the fact that the reinforcing base fabric is first associated with a canvas (11) and this canvas thus reinforced is then associated with the piece(s) of the collar (6).

* * * * *